US006180046B1

(12) United States Patent
Ditcher et al.

(10) Patent No.: US 6,180,046 B1
(45) Date of Patent: Jan. 30, 2001

(54) METHOD AND APPARATUS FOR CASTING WIRE REINFORCED MEMBERS UTILIZING MEMBERS FOR POSITIONING AND SUPPORTING THE WIRE REINFORCEMENTS

(75) Inventors: Scott Ditcher, Langhorne; Robert M. Kelly, Warminster, both of PA (US)

(73) Assignee: Atlantic Precast Concrete, Inc., Tullytown, PA (US)

( * ) Notice: Under 35 U.S.C. 154(b), the term of this patent shall be extended for 0 days.

(21) Appl. No.: 09/251,543

(22) Filed: Feb. 17, 1999

Related U.S. Application Data

(60) Division of application No. 08/853,515, filed on May 9, 1997, now Pat. No. 5,932,255, which is a continuation-in-part of application No. 08/748,010, filed on Nov. 12, 1996, now abandoned.

(51) Int. Cl.[7] ..... B28B 5/00

(52) U.S. Cl. ..... 264/263; 264/138; 264/274; 264/275; 264/333

(58) Field of Search ..... 264/138, 263, 264/274, 275, 277, 278, 271.1, 279.1, 333, 334; 249/91, 144, 214

(56) References Cited

U.S. PATENT DOCUMENTS

| | | | | |
|---|---|---|---|---|
| 3,785,610 | * | 1/1974 | Dagiel | 249/214 |
| 3,895,470 | * | 7/1975 | Wurth | 249/91 |
| 4,234,156 | * | 11/1980 | Wepf | 249/214 |
| 4,618,464 | * | 10/1986 | Ditcher | 264/274 |

* cited by examiner

*Primary Examiner*—Mathieu D. Vargot
(74) *Attorney, Agent, or Firm*—Volpe and Koenig P.C.

(57) ABSTRACT

A wire reinforced cast member is produced by providing inner and outer mold forms. At least one mounting projection of a wire reinforcement support member is supported in at least one opening in one of the inner and outer mold forms. A plurality of support members cooperate to support and substantially accurately position a wire reinforcement member, which member is mounted into support slots in the support member, which slots may snap-fittingly receive the wire reinforcement. The support members maintain the wire reinforcements in proper position during the introduction of the cast material. After the cast material has set, the cast member is removed from the mold. The support members have mounting portions which easily break away from the main body of the support members as the wire reinforced cast member is removed from the mold.

7 Claims, 5 Drawing Sheets

METHOD AND APPARATUS FOR CASTING WIRE REINFORCED MEMBERS UTILIZING MEMBERS FOR POSITIONING AND SUPPORTING THE WIRE REINFORCEMENTS

RELATED APPLICATIONS

This Application is a divisional of application Ser. No. 08/853,515, filed May 9, 1997, now U.S. Pat. No. 5,932,255, which is a continuation-in-part of application Ser. No. 08/748,010 filed Nov. 12, 1996, now abandoned

FIELD OF THE INVENTION

The present invention relates to method and apparatus for producing wire reinforced cast members and more particularly to such method and apparatus utilizing wire reinforcement support members which support and accurately position the wire reinforcements, and having a mold mounting portion which readily breaks away from the mold members when the cast member has set and is removed from the mold.

BACKGROUND OF THE INVENTION

The conventional technique for producing cast members such as manhole assemblies comprises the steps of pouring the cast material, i.e. concrete, into a mold containing a cylindrical shaped grid of wires placed within the mold and serving as a reinforcement for the cast member. The wire grid typically comprises a plurality of vertically aligned wires joined to horizontally aligned hoops, forming the grid-like framework. When the cast material is set, the cast member is removed from the mold. The wire reinforcement is embedded in the cast material, typically concrete.

Investigation and analysis by the authorities responsible for establishing specifications for manhole assemblies have recently developed new specifications, which permit the use of one or more lines of hoop steel in place of the grid-like wire mesh of conventional design. These new specifications result from the fact that once manhole assemblies are installed, they are in compression whereas reinforcement steel has been utilized in concrete to provide reinforcements for a cast member under tension.

Thus, the new specifications require that circular manholes need only be provided with steel reinforcement satisfactory for handling purposes preparatory to in-ground installation with the result that the new specifications permit manhole assemblies of certain sizes and thicknesses to have a reduction in reinforcement steel content enabling the use of round steel hoops in the place of conventional steel mesh (i.e. welded wire fabric arranged in a grid-like pattern). In view thereof, it is necessary to provide proper support, alignment and positioning of the steel hoops in place of the conventional longitudinal elements used in conventional designs and which are no longer required.

BRIEF DESCRIPTION OF THE INVENTION

The present invention is characterized by comprising method and apparatus for producing steel reinforced cast members such as manhole assemblies and the like comprised of the steps of providing openings along one of the manhole mold members for supporting spacers; inserting projections provided on the spacers into the mounting openings provided therefor and positioning the steel hoops into recesses (i.e. holding portions) provided within each of a group of preferably equi-spaced hoop supports arranged about the periphery of a mold member to support and accurately position the steel hoops; pouring the concrete into the mold; allowing the cast material (concrete) to set; and removing the cast member from the mold when the cast material has set, whereupon the projections of the hoop supports break away from the main body thereof preferably along shear lines provided in the supports, the main body of the supports being embedded within the cast member.

Each of the supports is comprised of a body portion, preferably having a pair of projections for insertion into a pair of mounting openings in the mold member. The projections, in one preferred embodiment, preferably have an oversized flange portion which is force-fitted into the support openings to adequately retain the supports in position, unaffected by the pouring of the concrete into the mold.

Each support in said one preferred embodiment, is provided with an oblong recess which opens into an upper side of the support. The recesses each receive a portion of the steel hoop which is formed of a single loop of metal wire having a substantially circular cross-section. However, hoops of other cross-sectional configurations (rectangular, square, polygonal, etc) may be employed. The steel wire is snap-fitted into the recess and is retained and accurately positioned therein, and is unaffected by the pouring and setting of the concrete, thereby assuring proper positioning of the steel hoop within the cast member.

It is preferable to provide three (3) or more supports arranged at substantially equi-spaced intervals about the mold member to provide proper support for a steel hoop.

The supports are preferably provided with a pair of projections, which extend into the support openings to prevent the supports from twisting or turning during the casting process.

The supports are preferably formed of a suitable plastic or like material. Plastic is preferred as it is non-corrosive and can be designed of a durometer that is resilient enough for an easy force-fit, but brittle enough to readily break at shear points and are provided with a shear portion or line, preferably of a reduced thickness at a position slightly displaced from the projections inserted into the support openings in the mold member enabling the projections to easily and cleanly break away from the main body portion of the support when the cast material has set and the cast member is removed from the mold, the main body portion being retained embedded within the cast member.

Although the preferred embodiment preferably has a pair of projections inserted into openings provided within the mold member, one elongated projection may be provided as an alternative arrangement for providing the desired support and preventing turning of the support within the mold.

The supports are preferably produced by an injection molding process, and are formed as a unitary, one-piece structure. Alternatively, a support may be formed of a body member having bores for receiving projections which are force fitted into the bores.

The projections, in said one preferred embodiment, may be rod-shaped and extend into openings of a conforming size and shape for force-fittingly receiving the projections.

In another preferred embodiment, the projections are flange-like in nature and are arranged to fit into elongated slots which are wider at an insertion end and narrower at a locking end. The flanges are inserted into the wider ends of the receiving slots and are moved so as to slide along the receiving slots into the locking portions thereof. The flanges of the supports break away from the main body thereof in much the same manner as the first mentioned preferred embodiment.

OBJECTS OF THE INVENTION

It is therefore one object of the present invention to provide novel method and apparatus for forming manhole assemblies and the like and in which novel support members are utilized to support and accurately position metal reinforcement hoops during the casting process.

Still another object of the present invention is to provide novel method and apparatus for casting steel reinforced concrete members employing novel support members for supporting and accurately positioning steel reinforcement hoops within the cast member, said support members being designed to simply and readily mount to a mold member employed in the casting process.

Still another object of the present invention is to provide novel method and apparatus for casting steel reinforced concrete members employing novel support members for supporting and accurately positioning steel reinforcement hoops within the cast member, said support members being designed to simply and readily mount to a mold member employed in the casting process, and further having shear points which cause the portion of the support member extending out of the cast member to easily break away from the main body portion which is embedded in the cast member.

Still another object of the present invention is to provide novel method and apparatus for casting steel reenforced concrete members employing novel support members for supporting and accurately positioning steel reinforcement hoops within the cast member, said support members being designed to simply and readily mount to a mold member employed in the casting member and having flanges which slide into cooperating slots in one mold member, said flanges being adapted to easily break away from the main body of the support when the cast members removed from the mold assembly.

The above as well as other objects of the present invention will become apparent when reading the accompanying description and drawings in which:

DETAILED DESCRIPTION OF THE INVENTION AND PREFERRED EMBODIMENTS THEREOF

Figure 1B:
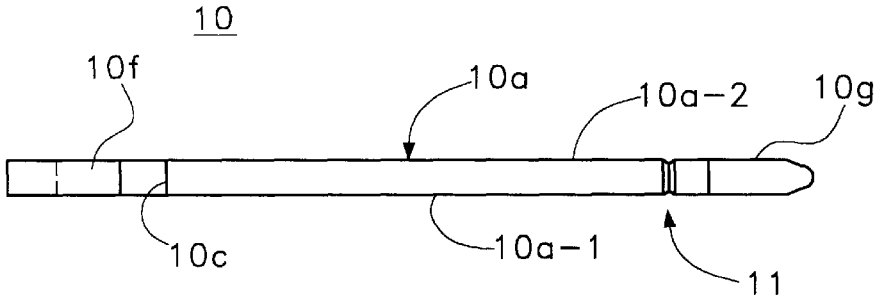
FIGS. 1*a* and 1*b* respectively show side and top views of a support member designed in accordance with the principals of the present invention.
Figure 1A:
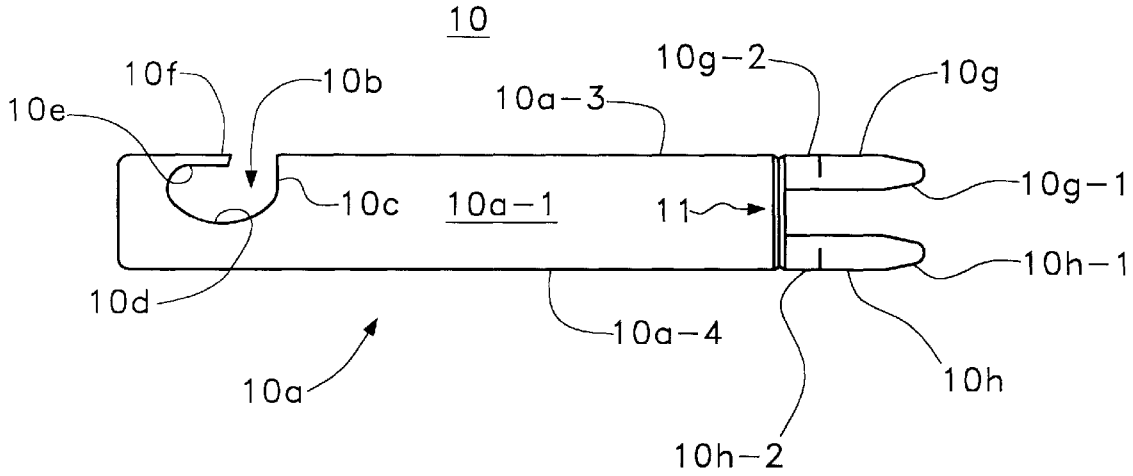

FIGS. 1*a* and 1*b* show a support member 10 designed in accordance with the principles of the present invention and which is comprised of a main body portion 10*a*, having a recess 10*b* provided with a linear sidewall portion 10*c* and a continuously curved portion 10*d* extending from the sidewall portion 10*c* and curving upward to define a substantially linear underside 10*e* of an overhanging projection 10*f*.

The right-hand end of main body portion 10*a* has integrally joined thereto a pair of substantially circular shaped projections 10*g*, 10*h*, each having tapered forward ends 10*g*-1 , 10*h*-1 tapering from a rounded point to portions 10*g*, 10*h* of a maximum diameter and having a slightly reduced diameter portion 10*g*-2, 10*h*-2 arranged between the maximum diameter portions 10*g* and 10*h* and the main body portion 10*a*. A shear line is formed by providing a substantially V-shaped groove extending continuously about the side surfaces 10*a*-1, 10*a*-2 and the top and bottom surfaces 10*a*-3 and 10*a*-4, the V-shaped groove 11 providing a weakening or shear line to facilitate breaking away of the projections 10*g* and 10*h*, as will be more fully described hereinbelow. The support member 10, as well as other embodiments to be described, is preferably formed of a suitable plastic, such as, polyproplyene, for example. However, any other suitable material having similar characteristics, may be employed.

The portions 10*g* and 10*h* are of slightly increased thickness for a purpose to be more fully described.

The unique manner in which the support member operates will now be described in conjunction with FIGS. 5 and 6. Making reference to FIG. 6, there is shown therein a mold assembly 60 for casting an eccentric and/or concentric cone which is typically one component, namely a top component, of a manhole assembly. It should be understood that other cast members may be cast using the same technique.

The mold assembly is comprised of outer and inner mold members 62 and 64 which define an eccentric and/or concentric cone.

The bottom flanges 62*a* and 64*a* of the outer and inner mold members rest upon a pallet member 66 having a top surface 66*a* of a configuration which forms the bottom of the eccentric and/or concentric cone to be cast.

An eccentric and/or concentric cone formed by the mold assembly 60 is typically provided with first, second and third steel hoops 68*a*, 68*b* and 68*c*. The support members, such as, for example, the support member 10 shown in detail in FIG. 1*a*, are utilized to accurately position the steel hoops 68*a*–68*c* within the mold assembly and further to provide proper spacing between the hoops.

Specifications typically require two (2) spaced hoops per cast member for cast members up to twenty-four inches (24") in length and three (3) spaced hoops for cast members up to forty-eight inches (48") in length.

Figure 5:
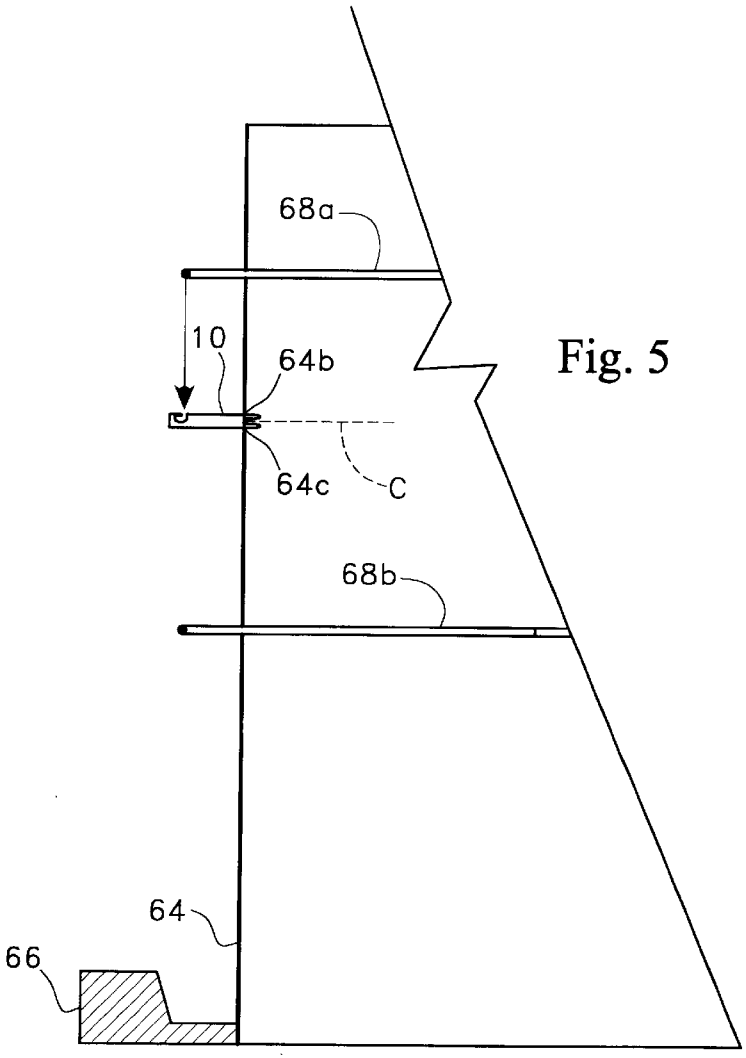
FIG. 5 is an elevational view partially sectionalized showing the manner in which the support members of the present invention are employed in the casting process.

In the embodiment shown in FIG. 1, pairs of holes are drilled preferably at equi-spaced intervals about an imaginary circle C (see FIG. 5).

The centers of each of the pairs of holes drilled into inner mold member 64 are aligned on a common vertical line with their center-to-center spacing being a function of the center-to-center spacing of projections 10*g*, 10*h*. In one typical embodiment, the outermost diameter portion 10*g* is 0.190 inches whereas the holes drilled into the inner mold member 64 have a diameter of 3/16th inches. The reduced diameter portion 10*g*-2 (as well as 10*h*-2) has a diameter of 3/16th inches whereby each of the support members 10 are force-fitted by either being driven or pushed into the holes such as, for example, holes 64*b* and 64*c* shown in FIG. 5, to align the support member 10 in the manner shown in FIG. 5. If necessary, the support member may be lightly tapped by a hammer or other like instrument to set the support member into place.

As was mentioned hereinabove, preferably three (3) support members should be placed along a common circle C to properly support and align the metal hoop 68*a*. The wire hoop is pressed downwardly through the opening 10*b* in each support member 10 and is of a dimension so that it rests in the outer portion of opening 10*b* and beneath the projection or overhang 10*f*.

Each of the hoops is arranged in a like manner.

After the projections 10*g*, 10*h* of all the supports have been inserted into the inner mold member and the hoops have been mounted to the support members, the cast material, typically concrete, is poured into the upper end of the mold assembly. The supports 10 have sufficient strength to retain the hoops, as well as the supports, in proper position.

After the mold is filled to the proper level with the cast material, the cast material is then allowed to set.

Once the cast material has set, the cast member, which may be provided with lifting rings, such as, for example, the lifting ring 70*a* and 70*b*, is lifted out of the mold assembly. As a result of the lifting, the projections 10*g*, 10*h* of each support member 10 break away from the main body portion 10*a* along the shear line defined by the V-shaped grooves 11, the main body portion 10*a* remaining embedded within the cast material.

The projections 10*g* and 10*h* which have been broken away are removed from the openings (such as openings 64*b*, 64*c*) in preparation for casting another eccentric and/or concentric cone, riser, base or other cast section.

The pairs of projections 10*g*, 10*h* prevent the support members from twisting or turning during the casting operation. The use of rounded projections simplifies the preparation necessary for mounting the support members to the mold member which merely requires the drilling of pairs of holes about the mold member.

Figure 2B:
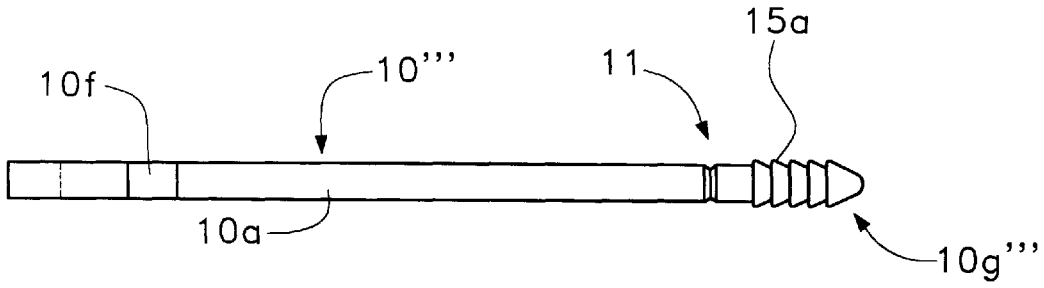
FIGS. 2*a* and 2*b* respectively show side and top views of an alternative embodiment for the support member of FIG. 1.
Figure 2A:
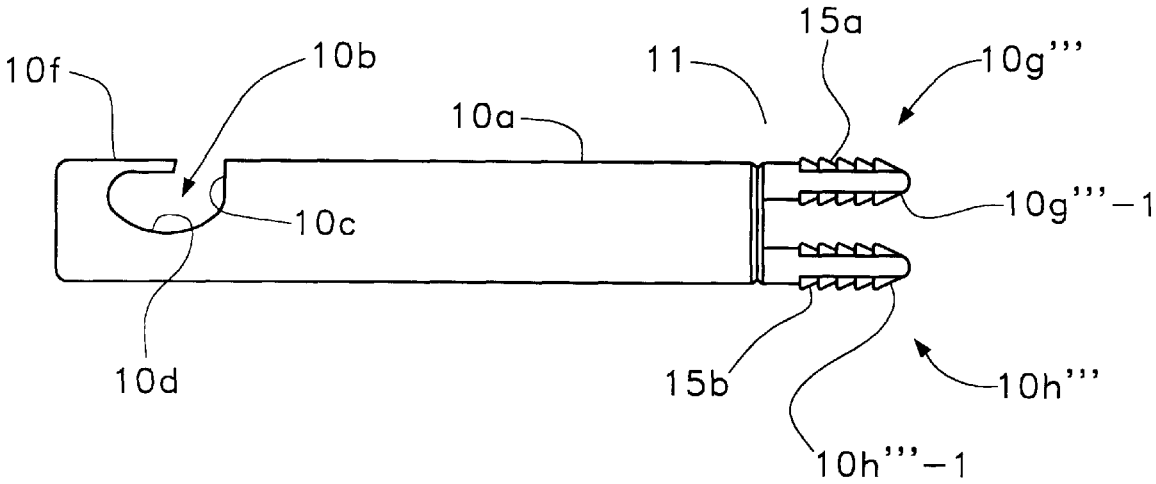

FIGS. 2*a* and 2*b* show another embodiment 10''' of the support member 10 shown in FIGS. 1*a* and 1*b* with the difference between the embodiments 10 and 10''' being the projections 10*g'''*, 10*h'''*. These projections have tapered portions 10*g'''*-1, 10*h'''* but differ in that the main body portions each have a saw-toothlike configuration 15*a*, 15*b* which serve to facilitate insertion of the projections into cooperating holes in the inner mold member but which substantially prevent the projections from being easily pulled out from the holes in the inner mold member.

The projections of the support member 10''' are force-fitted into cooperating openings in the inner mold member. If necessary the left-hand ends of the support members 10''' may be lightly tapped with a hammer or like instrument to assure their proper placement within the openings provided in the inner mold member. The manner in which the support members 10''' operate are then substantially similar to that described herein above with regard to support member 10. Similarly, the projections 10*g'''*, 10*h'''*, break away from the main body portion 10*a* along the shear line 11 in a manner similar to that described with regard to the embodiment 10.

Although the example given herein refers specifically to the casting of an eccentric cone portion of a manhole assembly, it should be understood that the same techniques apply when casting other members of a manhole assembly such as, a concentric cone, a manhole base or manhole riser. In addition, any type of reinforced cast member requiring line reinforcement such as at least one reinforcing hoop can use the technique of the present invention and may be fabricated using the same techniques and support members described herein. Thus, this technique can be used where any single line of steel is used in place of wire fabric i.e. single line reinforcing can be used in non-reinforced precast concrete for safety handling. In addition, the hoops need not be circular but may be formed in other shapes such as oblong, rectangular, square, or other polygonal shapes depending upon the shape of the member being cast. Also, the supports 10 may be mounted to the interior of outer mold member 62 if desired.

FIGS. 3*a* through 4*b* show other alternative embodiments of the support member of the present invention.

Figure 3A:
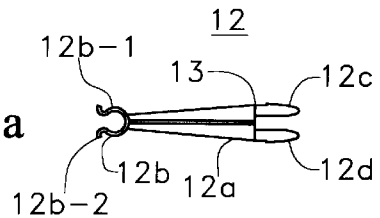
FIGS. 3*a* through 3*c* show side views of still further alterative embodiments of the support of the present invention.

In FIG. 3*a*, support member 12 differs from support member 10 in that the main body portion 12*a* tapers from a wide end portion to a narrow end portion which is provided with an integral, substantially U-shaped holding portion 12*b* into which the wire hoop is snap-fitted. A pair of projections 12*c*, 12*d* are integrally joined to the main body portion 12*a*. A shear line 13 is provided between the right-hand end of main body portion 12*a* and projections 12*c* and 12*d*.

The support 12 operates in substantially the same manner as support member 10 with the exception that the hoop is snap-fitted into the substantially U-shaped holding portion 12*b* with the free ends 12*b*-1 and 12*b*-2 serving to hold the hoop, such as hoop 68*a*, within the holding portion. The projections 12*c* and 12*d* are inserted into the openings provided in the mold member and are broken away along the strain line 13 when the cast member is removed from the mold assembly after the cast material is set.

Figure 3B:
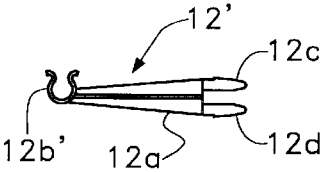

The embodiment 12' of FIG. 3*b* is similar in design to and operates in substantially the same manner and support 12 except that the holding portion 12*b'* is arranged in a upright fashion, the hoop being snap-fitted into portion 12*b'* in substantially the same manner as the holding portion 12*b*.

Figure 3C:
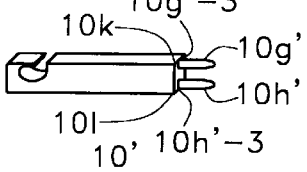

FIG. 3*c* shows in a support member 10' similar to the support member 10 except that the projections 10*g'*, 10*h'* are provided with left-hand ends 10*g'*-3, 10*h'*-3 of a reduced diameter in order to be force-fittingly inserted into the holes 10*k*, 10*l* provided in the right-hand end of main body portion 10*a*. The projections 10*g'* and 10*h'* are then force-fittingly inserted into these openings and the support member 10' is then mounted upon the mold member 64 in a manner similar to that described hereinabove for support members 10. The portions 10*g'*-3 and 10*h'*-3 are of sufficiently reduced thickness as to break away from the main body portion. In addition a stress line 11' may be provided where the reduced diameter portion 10*g'*-3 is joined to the increased diameter portion of the projection 10*g'*.

Figure 4A:
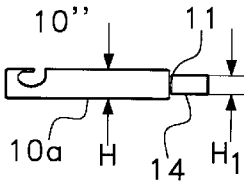
FIGS. 4*a* and 4*b* respectively show side and top views of still another alternative embodiment of the present invention.
Figure 4B:
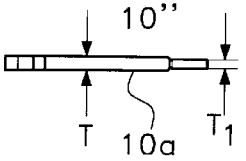

FIGS. 4*a* and 4*b* show still another embodiment 10" wherein the projections 10*g* and 10*h* of the embodiment 10 of FIG. 1, for example, are replaced by a single projection 14 having a height H1 less than the height H of main body portion 10*a* and having a thickness T1 less than the thickness T of main body portion 10*a*. The strain line 11 is provided between projection 14 and the main body portion in much the same manner as that shown in the embodiment 10 of FIG. 1A. Although only a single projection is provided in the embodiment 10", the length of the projection is sufficient to prevent the support member 10" from twisting or turning after it is inserted into an opening provided in the mold member. However, it is necessary to provide an elongated rectangular-shaped slot in the mold member for receiving the single projection 14 which is somewhat more difficult to form in the mold member than drilling of two holes for each of the projections 10*g*, 10*h* in the embodiment of FIG. 1*a*.

Figure 7A:
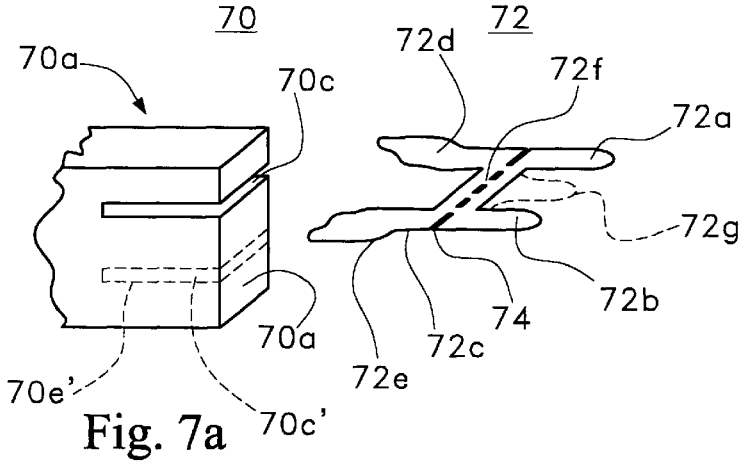
FIGS. 7*a* and 7*b* are perspective and sectional views, respectively, of another embodiment of the present invention.
Figure 7B:
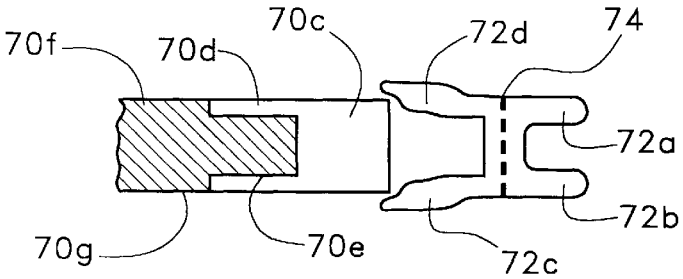

FIGS. 7*a* and 7*b* show still another embodiment 70 of the present invention in which the main body portion 70*a* is provided with a slot 70*c* extending into the right hand surface 70*a*. Although not shown for purposes of simplicity, the left-hand end of body portion 70*a* is provided with either an opening such as 10*b* in FIG. 1*a*, or a holder 12*b* or 12*b*', shown in FIGS. 3*a* and 3*b*. A pair of grooves 70*d*, 70*e* extending along opposite sides of body 70*a* communicate with the inner ends of slot 70*c* and extend along side surfaces 70*f*, 70*g*, respectively. The projection assembly 72 is a molded plastic member having a pair of projections 72*a*, 72*b* similar to the projections 10*g*, 10*h* and the embodiment 10, for example. The projections 72*a*, 72*b* are integrally joined to a substantial C-shaped coupling assembly 72*d*, 72*e*. The inner edges of arms 72*d*, 72*e* rest in recesses 70*d*, 70*e* respectively and the yoke portion 72*f* is received within slot 70*c*. The thicknesses of the arms 72*d*, 72*e* and the yoke portion 72*f* are preferably slightly greater than the gap space of slot 70*c* and grooves 70*d* and 70*e* to provide a force fitting coupling between main body portion 70 and projection portion 72.

If desired only one such projection assembly 72*g* need be provided (similar to projection 14 in FIG. 4*a*). Alternatively a second such projection assembly may be provided to be inserted into a similar slot 70*c*', and grooves 70*d*', 70*e*'. As a further alternative, when two such projection assemblies are utilized, the pair of projections 72*a*, 72*b* may be replaced by a single projection 72*g* for each of the projection assemblies. Each of the projection assemblies is provided with a shear line 74 similar to the shear line 11 of the embodiment 10, for example, to facilitate breaking away of the projection portion from the main body portion. Since the longest dimension of the shear line lies in the plane which is transverse to the direction of movement of the cast member from the mold assembly, this orientation facilitates breaking away of the projection (or projections) from the main body portion 70*a*.

Figure 8A:
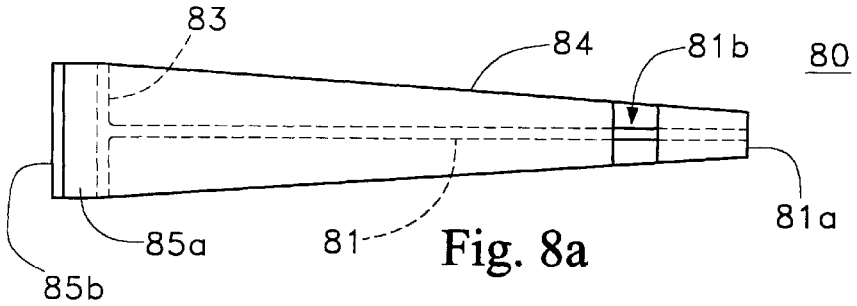
FIGS. 8*a*, 8*b* and 8*c* are top, side and end views of still another preferred embodiment of the present invention.
Figure 8B:
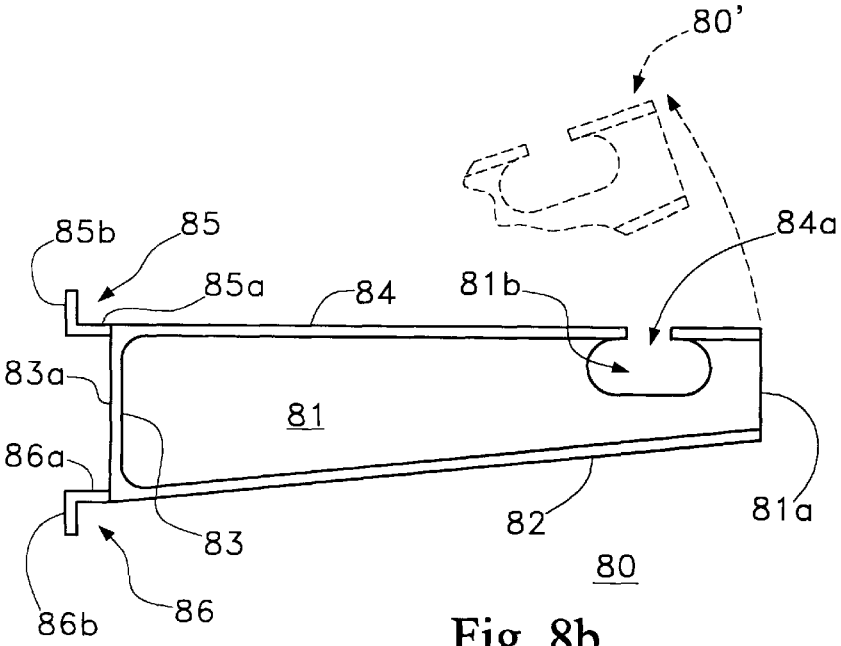
Figure 8C:
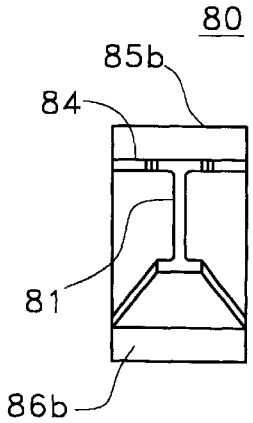

FIGS. 8*a*, 8*b* and 8*c* show still another embodiment 80 utilized as a support for wire hoops and functioning in the same manner as the embodiments described hereinabove in FIGS. 1 through 7*b*. The support 80 has a main body portion 81 which is wider at its left-hand end and tapers to a narrow right-hand end 81*a*. A lower reinforcement flange 82 is integrally joined to the lower end of main body portion 81 forming a substantially inverted T-shaped configuration. A left-hand end reinforcement flange 83 is integrally joined to the left-hand end of main body portion 81 forming a substantially T-shaped cross section as shown best in FIG. 8*a*.

The top end of main body portion 81 is joined to an integral upper reinforcement flange 84 forming a substantially T-shaped cross section with main body portion 81. A substantially oval-shaped slot 81*b* is formed in main body portion 81. The portion 84*a* of upper flange 84 immediately above slot 81*b* is likewise removed to enable insertion of a wire hoop into the slot 81*b*.

A pair of supporting flanges 85 and 86 are joined at the left-hand (i.e. mounting) end of the support 80, the upper flange located at the corner defining the merger between flanges 83 and 84 and the lower mounting flange 86 being located at the corner defining merger of flanges 82 and 83.

Flanges 82 and 84, as can best be seen in FIGS. 8*a* and 8*c*, have a tapered shape and are wider at their left-hand ends where they merge with flange 83, and taper to a narrow width where they terminate together with the right-hand end 81*a* of main body portion 81.

Upper mounting flange 85 has a flange portion 85*a* extending away from flange 83 and a portion 85*b* extending upwardly and at right angles from flange portion 85*a*. Similarly, the mounting flange 86 has a flange portion 86*a* extending away from flange 83 and a flange portion 86*b* extending downwardly and at right angles from flange portion 86*a*. The width of flanges 85 and 86 can be seen to be equal the maximum width of flanges 82 and 84 as well as the substantially constant width of flange 83.

Figure 9:
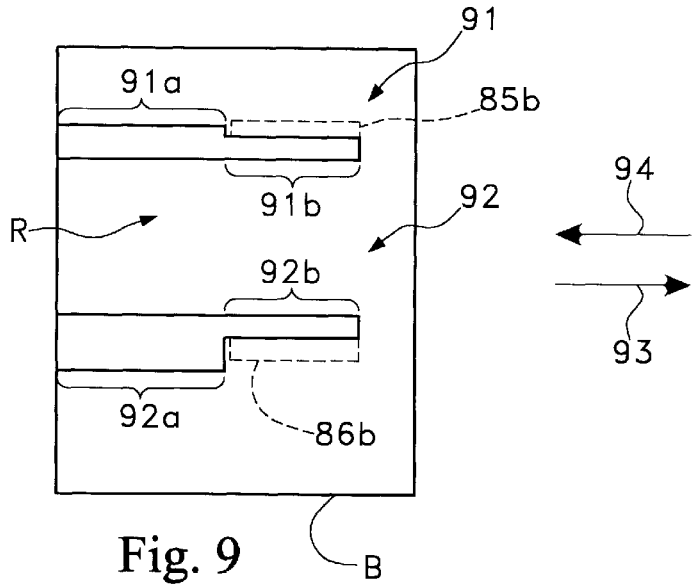
FIG. 9 is a plan view showing the arrangement of the slots utilized to support the embodiment of FIGS. 8*a*–8*c* during casting.

The manner in which the support 80 is mounted within a mold assembly can be best understood from a consideration of FIG. 9, together with FIGS. 8*a* through 8*c*.

One of the mold members, preferably the mold member defining the interior wall of the man hole to be cast is provided with a pair of elongated slots 91 and 92. Slot 91 has a slot portion 91*a* which has a width greater than the width of slot portion 91*b*. Similarly, elongated slot 92 has a slot portion 92*a* of a width greater than the slot portion 92*b* and preferably of a width greater than the slot portion 91*a*.

The manner in which the support 80 is mounted into the slots is as follows:

The support 80 is tilted so that its end 81*a* is swung through an angle from the horizontal position shown in FIG. 8*b* to the dotted line position 80', also shown in FIG. 8*b*.

With the support 80 at the orientation 80', the flange 85 is brought substantially into alignment with slot portion 91*a* and flange portion 85*b* is slipped into slot portion 91*a* (the width $w_1$, of slot portion 91*a* is slightly less than the height h of flange portion 85*b*).

With the flange portion 85*b* now inserted into slot portion 91*a*, the support is tilted downwardly to move flange 86 into alignment with slot portion 92*a*. Sufficient clearance is provided to allow flange portion 86*b* to enter into slot portion 92*a* (the width $w_2$ of slot portion 92*a* is slightly greater than the height h of flange 86*b*). The left-hand surface 83*a* of vertical flange 83 is positioned against the region R between slots 91*a* and 92*a*. With support 80 in this position, the support 80 is moved to the right as shown by arrow 93, causing the flange portions 85*b* and 86*b* to embrace the opposite surface of the mold member while flange portions 85*a* and 86*a* are captured within slot portions 91*b* and 92*b* (the width $w_3$ of the slots 91*b* and 92*b* are less than the height h of the flanges 85*b*, 86*b*)

Slot portions 91*b* and 92*b* firmly lock support 80 into position and the only way that the support can be removed is by breaking off flanges 85 and 86 or alternatively by moving support 90 in the direction of arrow 94 to return the flanges 85 and 86 to the region of flange portions 91*a* and 92*a* for removal.

As was previously described, it is preferable to provide slot arrangements 91 and 92 at 120° intervals about the inner-mold member. Once the supports 80 are mounted in the fashion described hereinabove, the wire hoops are inserted into the support slots 81*b*. It should be understood that a greater or lesser number of supports may be provided to support each hoop and, depending upon the height of the member being cast, the number of circular arrays may be modified. For example, FIG. 6 shows the use of three reinforcement hoops at three different positions within the height of the cast member. A greater or lesser number may be utilized as the function of the height of the member being cast and the structural strength desired.

The pairs of slots 91 and 92 utilized for mounting supports may be machined into the mold member or, alternatively, the slots may be formed in a rectangular-shaped blank B and the blank may be inserted into an opening formed in the mold member to accommodate blank B. Blank B is then joined, for example, by welding, to the mold member.

Figure 6:
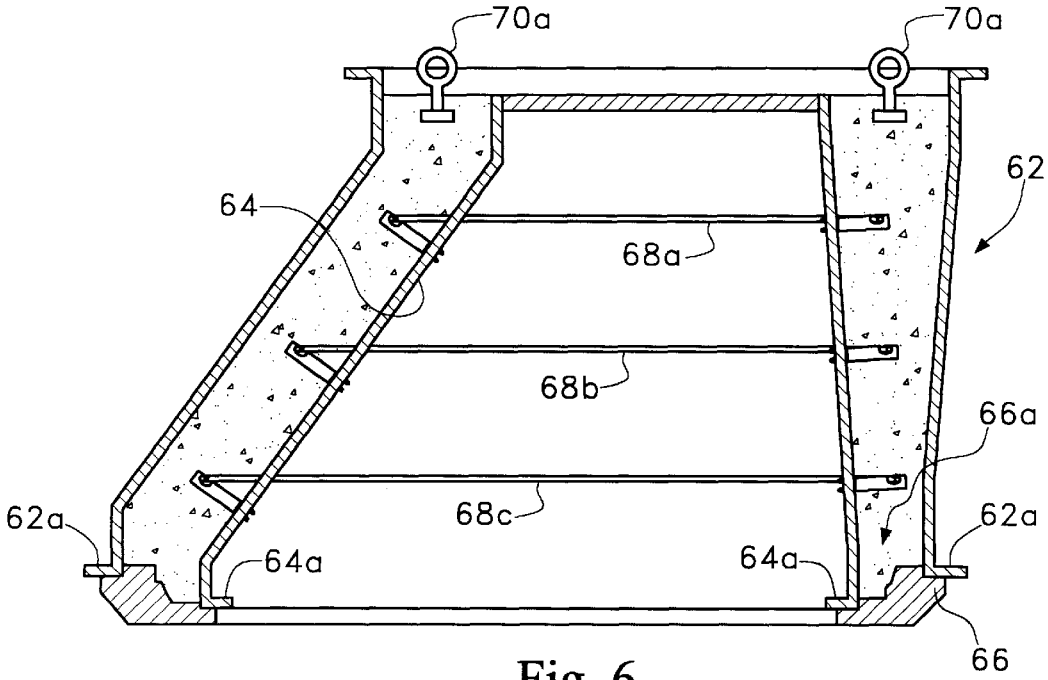
FIG. 6 is a sectional view of a manhole assembly showing the manner in which the mold support members and steel hoops are arranged for casting an eccentric and/or concentric cone.

Although the supports 80 are preferably arranged to be supported by the inner mold member, as shown in FIG. 6, the supports may be joined to the outer mold member, if desired.

When the supports are properly positioned and the metal hoops are properly mounted, the cast material is poured into the mold assembly. The reinforcement flanges 82, 83 and 84 provide significantly increased structural strength which is more than sufficient to withstand the concrete being poured into the mold. Once the mold is filled and the cast material has been set, the cast member is removed from the mold assembly. During removal, flanges 85 and 86 easily break away from flange 80.

Since the flanges 85 and 86, and specifically the flange portions 85*a* and 86*a*, are oriented substantially horizontally, their thickness and structural strength in the vertical direction is minimal, enabling the flanges to easily break-away from support 80, thus avoiding the need for shear lines in this embodiment.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for making a wire-reinforced cast member employing at least two support members each having at least one mounting projection and a wire supporting portion, comprising the steps of:

(a) providing a mold assembly comprising at least inner and outer mold members defining a hollow portion determining a shape of the member to be cast;

(b) inserting a mounting projection of said at least two support members into openings provided in at least one of said mold members;

(c) inserting the wire reinforcement into the wire supporting portion of said support members arranged in the hollow portion;

(d) filling the mold assembly with cast material;

(e) allowing the cast material to set; and (f) removing the cast member from the mold assembly whereupon the mounting projection breaks away from a main body of each of the support members, each main body remaining embedded in the cast member.

2. The method of claim 1 wherein step (b) further comprises:

(g) placing a plurality of support members at spaced intervals about said mold member by insertion of a mounting projection of each of said plurality of support members into an associated opening in a mold member provided therefore and wherein step (c) further comprises:

(h) inserting said wire reinforcement into the wire supporting portion of each support member.

3. The method of claim 2 wherein step (f) further comprises placing at least three support members at equally spaced intervals about the mold member.

4. The method of claim 1 wherein the support members are provided with a pair of mounting projections in the form of mounting flanges and said at least one of said mold members is provided with first and second elongated openings each of which is wider at a first end and narrower at a second end, and step (b) further comprises inserting each of the flanges respectively into the wider ends of the first and second elongated openings and sliding the support member so as to move the flanges respectively into the narrower ends of the first and second elongated slots.

5. The method of claim 4 wherein step (b) further comprises:

(g) placing a plurality of support members at spaced intervals about said mold member by insertion of a mounting projection of each of said plurality of support members into an associated opening in a mold member provided therefore and wherein step (c) further comprises:

(h) inserting said wire reinforcement into the wire supporting portion of each support member.

6. The method of claim 5 wherein step (f) further comprises placing at least three support members at equally spaced intervals about the mold member.

7. A method for making a wire-reinforced cast member employing at least two support members each having 1st and 2nd mounting flanges and a wire supporting portion, comprising the steps of:

(a) providing a mold assembly comprising at least inner and outer mold members defining a hollow portion determining a shape of the member to be cast; providing mounting slots for said flanges in one of said mold members;

(b) providing first and second mounting slots in one of said mold members for said at least two support members;

(c) inserting each flange of said at least two support members into an associated slot in said one of said mold members;

(d) inserting the wire reinforcement into the wire supporting portion of said support members arranged in the hollow portion;

(e) filling the mold assembly with cast material;

(f) allowing the cast material to set; and (g) removing the cast member from the mold assembly whereupon the mounting flangers break away from a main body of each support member along a shear line positioned between said mounting flanges and said main body, each main body remaining embedded in the cast member.

* * * * *